US006561953B1

(12) United States Patent
Chang

(10) Patent No.: US 6,561,953 B1
(45) Date of Patent: May 13, 2003

(54) SUPPORTING FRAME OF RUNNING EXERCISER MADE OF PLASTICIZING MATERIAL

(76) Inventor: Susan Chang, No. 1, Wangjian Tsuen, Shinwu Hsiang, Taoyuan Hsien (TW)

( * ) Notice: Subject to any disclaimer, the term of this patent is extended or adjusted under 35 U.S.C. 154(b) by 0 days.

(21) Appl. No.: 09/553,748

(22) Filed: Apr. 21, 2000

(51) Int. Cl.[7] ..... A63B 22/02
(52) U.S. Cl. ..... 482/6; 482/51; 482/54
(58) Field of Search ..... 482/51, 54, 6

(56) References Cited

U.S. PATENT DOCUMENTS 4,616,822 A * 10/1986 Trulaske et al. ..... 482/54
5,709,632 A * 1/1998 Socwell ..... 482/54
5,897,461 A * 4/1999 Socwell ..... 482/54
6,042,514 A * 3/2000 Abelbeck ..... 482/54
6,095,951 A * 8/2000 Skowronski et al. ..... 482/54

* cited by examiner

*Primary Examiner*—Glenn E. Richman
(74) *Attorney, Agent, or Firm*—Rosenberg, Klein & Lee

(57) ABSTRACT

A supporting frame of a running exerciser made of a plasticizing material comprises two lateral frames, and a plurality of transversal frames. The two lateral frames is installed at the left and right sides and being made of plasticized material. The inner side of each lateral frame is integrally formed with a plurality of buckling seats and supporting seats. The supporting seats are located below the buckling seat The plurality of transversal frames are spaced and installed between the two lateral frames. The two ends of each transversal frame are buckled to the buckling seat, so that the two ends of each transversal frame being supported by the supporting seat. Therefore, a supporting frame of a running exerciser made of a plasticizing material is assembled.

6 Claims, 4 Drawing Sheets

SUPPORTING FRAME OF RUNNING EXERCISER MADE OF PLASTICIZING MATERIAL

FIELD OF THE INVENTION

The present invention relates to a supporting frame of a running exerciser made of a plasticizing material. Thereby, the weight of the supporting frame is reduced greatly and the outlook and shape thereof can be changed.

BACKGROUND OF THE INVENTION

Although human life has improved greatly, peoples have less time for exercising so that the human body is easy to get sick. Therefore, various exerciser are inventive. Running exerciser is a general used exerciser. The prior art running exerciser has a running table having a supporting frame. The supporting frame is made by welding metal. The front and rear sides of the supporting frame have respective rollers. A running strap is connected between the front and rear rollers. The user standing on the tilt strap will slide down naturally for generating a power for running. As the user treading on the strap will cause the strap to rotate backwards cyclically, the object of running is achieved.

However, the prior art supporting frame of a runner exerciser is completely made of metal so as to have a heavy weight. If the transport fee is charged by weight, it is uneconomic and the burden of the operator is increased. Moreover, the utility and safety are not good. After the supporting frame of metal material is welded and assembled, it can not be detached and occupied a larger space. The costs in storage and transport are high. Moreover, the supporting frame of a prior art runner exerciser is made by welding metal. The outlook, shape and color are seldom changes and thus the consumption requirement is very difficult to increased.

SUMMARY OF THE INVENTION

Accordingly, the primary object of the present invention is to provide a supporting frame of a running exerciser made of a plasticizing material. Thereby, the weight of the supporting frame is reduced greatly so that the transferring cost is reduced to a minimum valve and the burden of the operator also decreased. Therefore, it has a preferred safety and utility. The supporting frame is formed by assembling. After being assembled, it can be detached so that it only occupies a small space. As a result, the costs in manufacturing, production and transformation are reduced greatly.

Another object of the present invention is to provide a supporting frame of a running exerciser made of a plasticizing material. The two lateral frames of the supporting frame 10 are made of plastics and other plasticized material. It can be manufactured with different colors or outlooks by injection molding. The supporting frame has different variations so as to increase the consumption requirement of the consumers.

In order to achieve aforesaid objects, the present invention provides a supporting frame of a running exerciser made of a plasticizing material comprising two lateral frames, and a plurality of transversal frames. The two lateral frames are installed at the left and right sides and being made of plasticized material. The inner side of each lateral frame are integrally formed with a plurality of buckling seats and supporting seats. The supporting seats are located below the buckling seat The plurality of transversal frames are spaced installed between the two lateral frames, and two ends of each transversal frame are buckled to the buckling seat, so that the two ends of each transversal frame being supported by the supporting seat. Therefore, a supporting frame of a running exerciser made of a plasticizing material is assembled.

The various objects and advantages of the present invention will be more readily understood from the following detailed description when read in conjunction with the appended drawing.

DETAILED DESCRIPTION OF THE PREFERRED EMBODIMENTS

Figure 1:
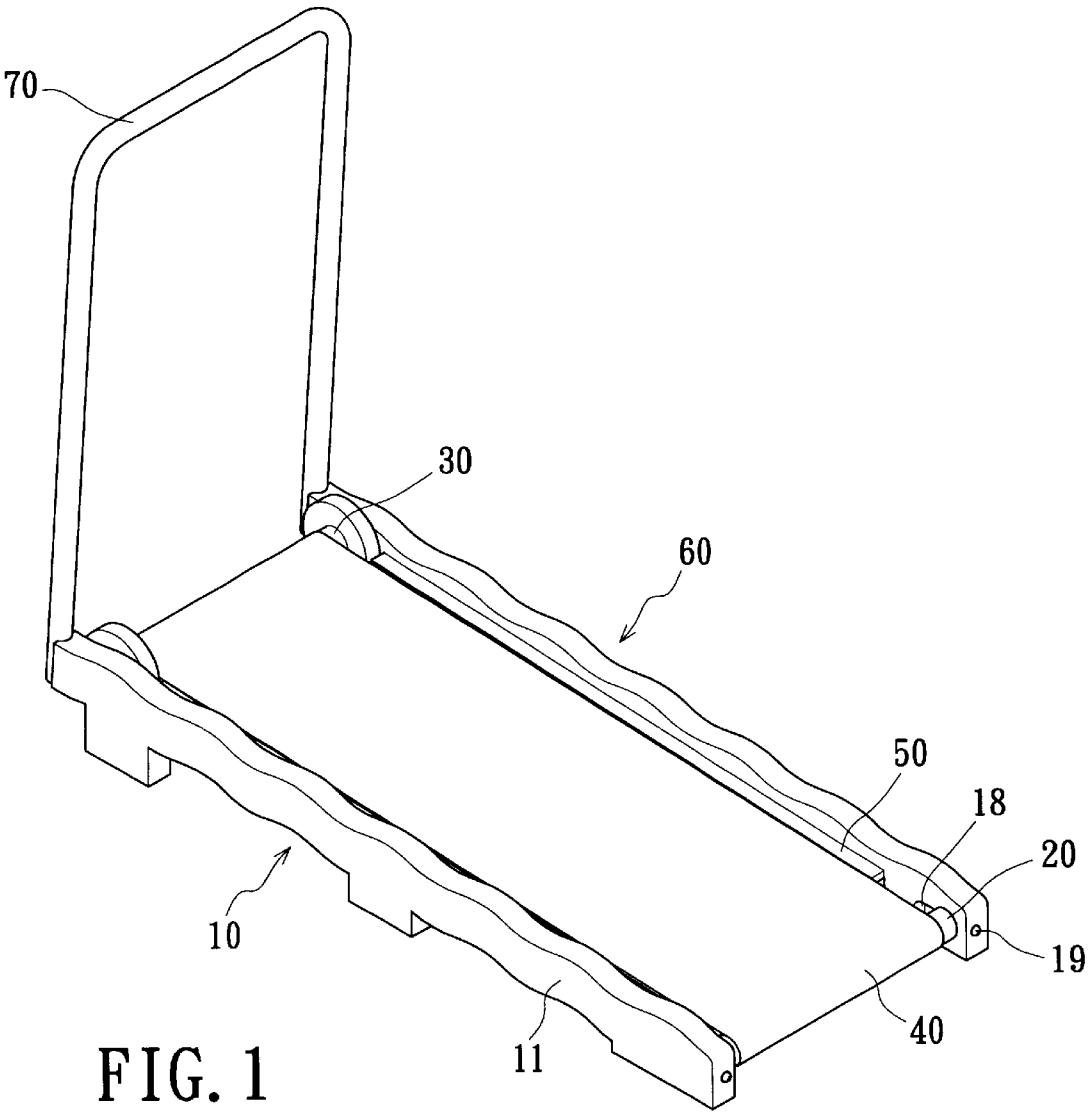
FIG. 1 is an assembled perspective view of the present invention.
Figure 2:
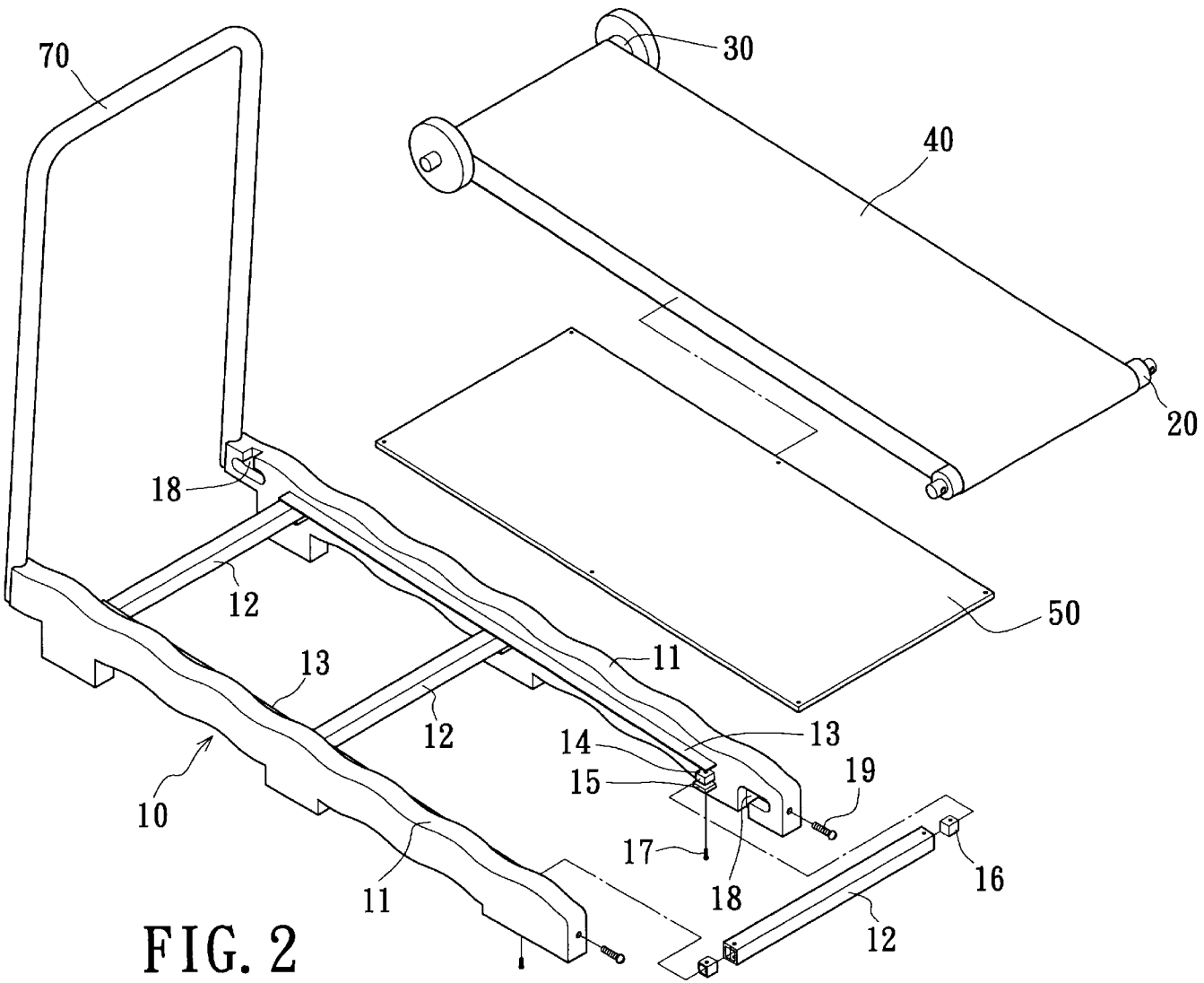
FIG. 2 is an exploded perspective view of the present invention.
Figure 3:
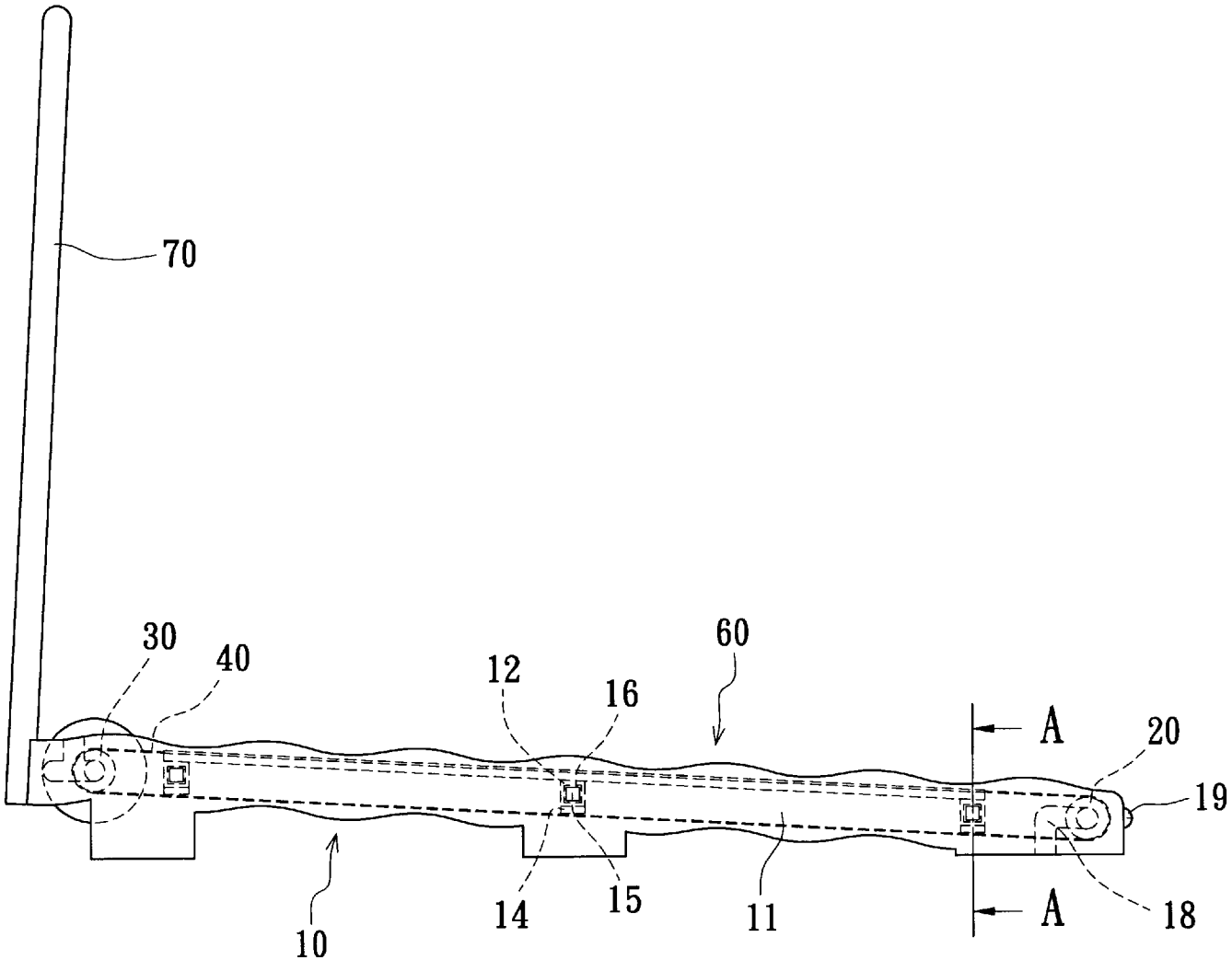
FIG. 3 is a plan schematic view of the present invention.
Figure 5:
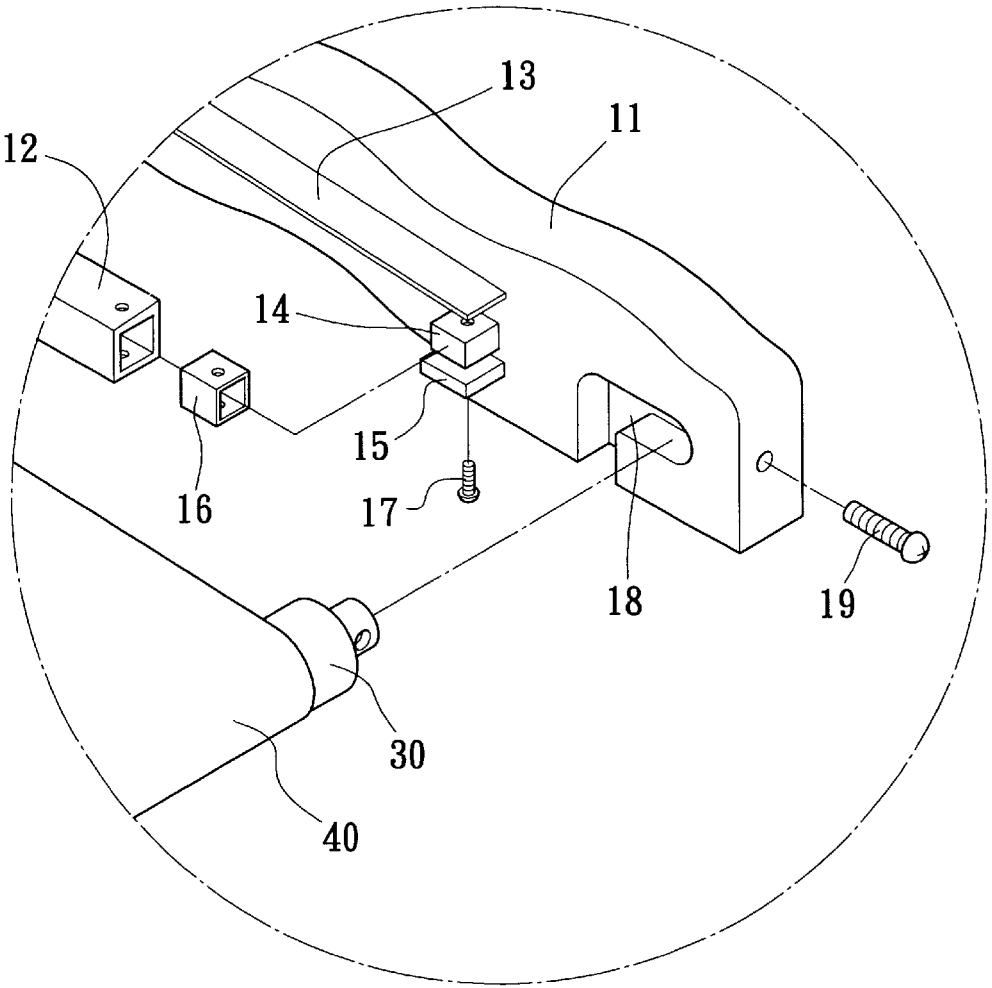
FIG. 5 is a cross sectional view along line A—A of FIG. 3
Figure 4:
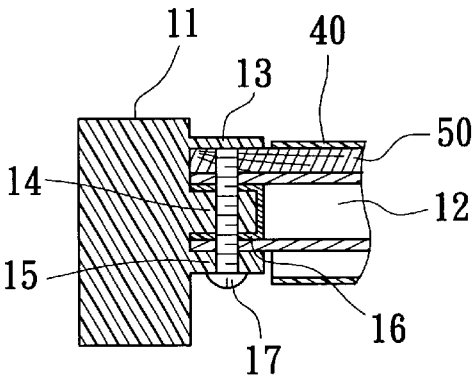
FIG. 4 is an exploded perspective view showing a part of the present invention.

With reference to FIGS. 1, 2, and 3, the assembled perspective view, exploded perspective view, and the plan schematic view of the present invention are illustrated therein. The present invention provides a supporting frame of a running exerciser made of a plasticizing material. The supporting frame 10 includes two lateral frames 11 and a plurality of transversal frames 12. The lateral frames 11 are divided as a left lateral frame and a right lateral frame which are opposite to one another. The two lateral frames 11 are made of plasticizing material, such as plastics, and have a proper length. The inner side of each lateral frame 11 is integrally formed with a plurality of buckling seats 14 and supporting seat 15 (Referring to FIGS. 4 and 5). Each buckling seat 14 has a rectangular shape or other shapes corresponding to the inner diameter of the transversal frame 12. The supporting seat 15 is placed below the buckling seat 14. Moreover, the inner side of each lateral frame 11 is integrally formed with a stopper 13 which is positioned above the buckling seat 14. Moreover, at the front and rear ends of the inner side of each lateral frame 11 have a respective "L" shape groove 18.

The transversal frame 12 is made of metal, which is a hollow tube with a rectangular cross section or other shapes. The transversal frame 12 has a proper length. Each of the two ends of the each transversal frame 12 has an inner liner 16 made of plasticizing material and matching with the inner diameter thereof. The inner diameter of the inner liner 16 is correspondent to the outer diameter of the buckling seat 14. The transversal frames 12 are installed between the two lateral frames 11. The inner liners 16 of the transversal frames 11 are buckled to the outer portion of the buckling seats 14 so that two ends of the transversal frames 12 are supported by the supporting seats 15. Thus, the transversal frames 12 are steadily connected between the two lateral frames 12. Thereby, a supporting frame of a running exerciser made of a plasticizing material is formed.

The supporting frame 10 of the present invention can be installed in the general used runner exerciser. The supporting frame 10 is obliquely installed. The front and rear sides of the supporting frame 10 are pivotally installed with respective rollers 20 and 30 through an assembly groove 18. The rotary shafts of the two rollers 20 and 30 can be locked to the lateral frames 11 by screws 19. A running strap 40 is installed between the two rollers 20 and 30. Another, a plate 50 is installed on the supporting frame 10 for supporting a flexible runner strap 40, and thus a runner table 60 is formed. Furthermore, screws 17 can be screwedly connected to the buckling seats 14 and the supporting seat 15 for locking the plates 50 and the transversal frames 12. The stopper 13 serves to shield the two lateral front sides of the plate 50. Thereby, shielding and stopping functions are provided. Further, a handle 70 is installed at the front end of the supporting frame 10 for being held by a user conveniently. A user stood on the oblique runner exerciser will slide down naturally for generating a power for running. As the user treads on the running exerciser, the running strap 40 will run backwards so as to achieve the object of cycling the strap 40.

In the present invention, the two lateral frames 11 of the supporting frame 10 is made of plasticizing material, and by the buckling seats 14 and the supporting seats 15 to be connected to the transversal frames 12, the weight of the supporting frame is reduced greatly so that the transferring cost is reduced to a minimum valve and the burden of the operator also decreased. Therefore, it has a preferred safety and utility. The supporting frame 10 is formed by assembling. After being assembled, it can be detached so that it only occupies a small space. As a result, the costs in manufacturing, production and transfer are reduced greatly. Moreover, the two lateral frames 11 of the supporting frame 10 are made of plastics and other plasticized material. It can be manufactured with different colors or outlooks by injection molding. The supporting frame 10 has different variation so as to increase the consumption requirement of the consumers.

As a summary, the supporting frame of a running exerciser made of a plasticizing material according to the present invention has substantially improved some defects in the prior art, such as heavy, high transfer cost, increasing the burden of the operator, bad utility and safety, occupying a large space, not being detached after being assembled, high costs in storage, and dull in outlook, colors and shapes.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A supporting frame assembly for a treadmill comprising:

(a) a pair of longitudinally extended lateral frame members formed of a plasticizing material containing composition, each said lateral frame member having integrally formed at an inner side thereof a plurality of transversely protruding buckling seat portions, and, (b) a plurality of transversal frame members extending transversely between said lateral frame members, each said bucking seat portion having a protruding shape corresponding to an inner diameter of said transversal frame members, said transversal frame members being spaced one from the others, each said transversal frame member terminating at a pair of hollow end portions, each said hollow end portion telescopically coupling to one said lateral frame member buckling seat portion for retentive engagement therewith.

2. The supporting frame assembly as recited in claim 1 wherein each said buckling seat portion of said lateral frame members is formed with a rectangular sectional contour.

3. A supporting frame assembly for a treadmill comprising:

(a) a pair of longitudinally extended lateral frame members formed of a plasticizing material containing composition, each said lateral frame member having integrally formed at an inner side thereof a plurality of transversely protruding buckling seat portions;

(b) a plurality of transversal frame members extending transversely between said lateral frame members, said transversal frame members being spaced one from the others, each said transversal frame member terminating at a pair of hollow end portions, each said hollow end portion telescopically coupling to one said lateral frame member buckling seat portion for retentive engagement therewith; and, (c) a plurality of inner liner members each disposed within one of said lateral frame member hollow end portions, each of said inner liner members being formed of a composition containing a plasticizing material and being contoured to telescopically receive one said lateral frame member buckling seat portion therein.

4. The supporting frame assembly as recited in claim 3 wherein each said lateral frame member has integrally formed at least partially along said inner side thereof a transversely protruding elongate stopper.

5. The supporting frame assembly as recited in claim 1 wherein said telescopically coupled hollow end and buckling seat portions are secured together by at least one screw fastener.

6. The supporting frame assembly as recited in claim 3 wherein each said lateral frame member has formed in said inner side respectively adjacent longitudinally opposed ends thereof a pair of grooves for receiving a roller axle.

* * * * *